US005518777A

United States Patent [19]

Shimamune et al.

[11] Patent Number: 5,518,777

[45] Date of Patent: May 21, 1996

[54] METHOD OF PRODUCING AN ELECTROLYTIC ELECTODE HAVING A PLASMA FLAME-COATED LAYER OF TITANIUM OXIDE AND TANTALUM OXIDE

[75] Inventors: Takayuki Shimamune; Yasuo Nakajima, both of Tokyo, Japan

[73] Assignee: Permelec Electrode Ltd., Kanagawa, Japan

[21] Appl. No.: 345,461

[22] Filed: Nov. 21, 1994

Related U.S. Application Data

[62] Division of Ser. No. 91,043, Jul. 14, 1993, Pat. No. 5,395, 500.

[30] Foreign Application Priority Data

Jul. 17, 1992 [JP] Japan ..... 4-213482

[51] Int. Cl.$^6$ ..... C23C 4/10

[52] U.S. Cl. ..... 427/454; 427/453; 427/126.3; 427/419.3; 427/125

[58] Field of Search ..... 427/453, 126.3, 427/419.3, 125, 454

[56] References Cited

U.S. PATENT DOCUMENTS

| | | | |
|---|---|---|---|
| 4,070,504 | 1/1978 | Bianchi et al. | 204/290 F |
| 4,510,034 | 4/1985 | Ohshima et al. | 204/290 F |
| 4,528,084 | 7/1985 | Beer et al. | 427/126.3 |
| 4,822,459 | 4/1989 | Ueda et al. | 427/126.3 |
| 5,204,302 | 4/1993 | Gorynin et al. | 502/2 |

*Primary Examiner*—Kathryn Gorgos
*Attorney, Agent, or Firm*—Sughrue, Mion, Zinn, Macpeak & Seas

[57] ABSTRACT

The instant invention relates to a method for manufacturing an electrolytic electrode comprising a core material made of a valve material, forming a plasma flame-coated layer containing the oxides of titanium and tantalum on the surface of the core material, forming an interlayer containing platinum and the oxides of titanium and tantalum on the surface of the plasma flame-coated layer, forming an α-lead dioxide layer on the interlayer and forming a β-lead dioxide layer on the α-lead dioxide layer.

6 Claims, No Drawings

METHOD OF PRODUCING AN ELECTROLYTIC ELECTODE HAVING A PLASMA FLAME-COATED LAYER OF TITANIUM OXIDE AND TANTALUM OXIDE

This is a divisional of application Ser. No. 08/091,043 filed Jul. 14, 1993, now U.S. Pat. No. 5,395,500.

FIELD OF THE INVENTION

The present invention relates to an electrolytic electrode capable of being electrolyzed in an aqueous solution, in particular, in an aqueous solution under corrosive conditions containing fluorine ions or fluoride ions, and also to a method of producing the electrolytic electrode.

BACKGROUND OF THE INVENTION

Lead dioxide is a compound having a metallic electric conductivity. Since lead has excellent durability, lead dioxide is, in particular, very stable at an anodic polarization in an acidic bath and, furthermore, can be relatively easily produced by an electrodeposition method, etc. Lead dioxide has been widely used, for example, as an industrial electrolytic anode for the production of explosives such as peroxides, perchlorates, etc.; raw materials for oxidizing agents; syntheses of organic compounds; water treatment; etc.

By utilizing these characteristics, block lead dioxide electrodes were practically used in the 1940's. The electrode being used was formed by cutting a pot-form iron having a lead dioxide layer formed on the inside surface thereof by electrodeposition. However, the production thereof was very troublesome, and the production yield was bad; further, such an electrode had a brittleness specific to ceramics, and the specific gravity thereof was about 9, which was larger than that of iron, whereby the electrode was difficult to handle. Hence, the usable ranges of the electrodes were limited.

However, since titanium having an excellent corrosive resistance to anodic polarization in an acidic solution has been commercially used since the 1950's, the cost of titanium has lowered, and titanium is now used more in the chemical industries. For example, a light-weight and durable lead dioxide electrode composed of the combination of titanium and lead dioxide has been produced, that is, an electrode composed of a titanium core having electrodeposited lead dioxide on the surface thereof. However, in the electrode, the interface between titanium as the core material and the lead dioxide layer was passivated by the strong oxidative power of lead dioxide, which sometimes resulted in making the passage of electric current impossible. Since electrically conductive titanium could not be used as the electrically conductive member, the lead dioxide layer itself was first used as the electrically conductive member. Thereafter, by spot-like welding platinum onto the surface of titanium to form an anchor, the electric conductivity was ensured.

Also, it became possible to obtain a good electric conductivity by applying a platinum plating to the whole surface of the titanium. However, this resulted in cracking the lead dioxide layer (and if a part of the lead dioxide layer was broken, platinum having a high activity to ordinary oxygen generation caused a reaction which peeled-off the lead dioxide layer).

The inventors previously solved the foregoing passivation problem by using semiconductive oxides of valve metals each having a different valent number. On the other hand, since the electrodeposition thickness of the lead dioxide layer on the surface of the core material was from 0.1 to 1 mm, which was thicker than the thickness of ordinary plating, the problem of peeling off the coating by an electrodeposition strain could not be avoided. However, the problem is being solved by laminating or mixing α-lead dioxide and β-lead dioxide or by variously selecting other electrodepositing conditions. However, from the viewpoint of improving the corrosion resistance of lead dioxide, increasing the electrodeposition strain is desirable and, hence, corrosion resisting particles are dispersed in the β-lead dioxide layer, as disclosed in, for example, U.S. Patent 4,822,459.

The lead dioxide electrode developed through the developing steps described above is considered to be an almost completed technique for an ordinary electrolytic reaction, but it was experienced that when the lead dioxide electrode was used in a fluoride-containing electrolyte containing fluorine ions or fluoride ions for a long period of time, hair cracks formed even though they were very slight and the electrolyte permeated through the cracks into the titanium portion of the ground, whereby corrosion resisting titanium was dissolved out.

As a countermeasure for the fluoride-containing electrolyte, it has been proposed that iron is used as the core material in place of titanium, an intermediate coating is strongly applied thereto, and a lead dioxide layer is formed on the surface thereof to constitute an electrode. However, once cracks form in such an electrode, the electrode is not sufficiently satisfactory since the corrosion resistance of iron as the core material is far inferior to that of titanium.

As described above, various investigations have been made on lead dioxide electrodes and various solving methods have been proposed. However, a lead dioxide electrode having a sufficient corrosion resistance and practical use to a fluoride-containing electrolyte, which is frequently used and is considered to be increasingly used hereafter, has not yet been realized.

SUMMARY OF THE INVENTION

The present invention solves the problems described above. Furthermore, an object of the present invention is to provide an electrolytic electrode giving a sufficient durability during electrolysis using various kinds of solutions, in particular, an aqueous solution containing fluorine ions or fluoride ions, and also to a method of producing the electrode.

Thus, according one aspect of the present invention, there is provided an electrolytic electrode comprising a core material made of a valve metal, a plasma flame-coated layer containing the oxides of titanium and tantalum formed on the surface of the core material, an interlayer containing platinum and the oxides of titanium and tantalum formed on the surface of the plasma flame-coated layer, an α-lead dioxide layer formed on the surface of the interlayer, and a β-lead dioxide layer formed on the α-lead dioxide layer.

Also, according to another aspect of the present invention, there is provided a method of producing the electrolytic electrode, which comprises forming an electrically conductive oxide layer containing titanium and/or tantalum on the surface of a core material made of a valve metal, forming a plasma flame-coated layer on the electrically conductive oxide layer by a plasma flame-coating method, forming an interlayer containing platinum and the oxides of titanium and tantalum on the surface of the plasma flame-coated layer by a thermal decomposition method, and forming an α-lead dioxide layer on the interlayer and then a β-lead dioxide layer on the α-lead dioxide layer.

DETAILED DESCRIPTION OF THE INVENTION

The present invention is described in detail below.

Since in the electrolytic electrode of the present invention, the core material is coated with two lead dioxide layers, an interlayer and a plasma flame-coated layer, even when cracks form in the lead dioxide layers during electrolysis, the electrolyte scarecely reaches the core material. Thus, when the electrode of the present invention is used, in particular, in a fluoride-containing electrolyte showing a high corrosive property, the electrode is maintained for a long period of time.

The electrode of the present invention can be produced as follows.

The core material of the electrode of the present invention may have a physical form-keeping function and a function as an electrically conductive member. There is no particular restriction on the core material if the material has these functions, and iron, stainless steel, nickel, etc., can be used. However, for minimizing the damage created when the lead dioxide layers and the plasma flame-coated layer are partially peeled-off or when perforations form in the foregoing plasma flame-coated layer, (the thickness of which is frequently about 100 μm) and, in particular, for enhancing the durability to fluoride ions, it is preferred to use a valve metal which is very stable at an anodic polarization. In these valve metals, titanium or a titanium alloy, which are easily handled and relatively inexpensive, are preferably used as the core material. In addition, the core material may be in various forms such as a tabular form, a perforated form, an expand mesh, etc.

It is preferable to apply a sufficient ground treatment to the core material. Examples of ground treatments which may be used in the present invention include a method of increasing the surface area by a blast treatment, a method of activating the surface by acid pickling, a method of carrying out a cathodic polarization in an electrolyte such as an aqueous sulfuric acid solution, etc., to generate a hydrogen gas from the surface of a substrate to carry out surface washing and carrying out an activation by a hydride partially formed by the hydrogen gas, etc., and by the ground treatment, pointed portions on the surface of the core material can be removed.

For further improving the corrosion resistance of the core material and for improving the bonding strength between a metal and a ceramic (by improving the affinity of the core material and the plasma flame-coated layer), it is preferred to form an electrically conductive oxide layer containing the metal forming the plasma flame-coated layer on the surface of the core material.

As the method of forming the electrically conductive oxide layer, in the case of the plasma flame-coated layer and the core material containing the same metal, there are various methods such as a method of directly oxidizing the core material to convert the surface thereof into an oxide, a thermal oxidation method, etc.

In the case of the direct oxidation method, the core material is heated in air to a temperature of from 500° to 600° C. for 10 minutes to 10 hours and, preferably, from 30 minutes to 2 hours, whereby the surface of the core material is oxidized to form a light-blue electrically conductive oxide layer of titanium and/or tantalum. On the other hand, in the case of the thermal oxidation method, a coating liquid containing at least one of the metals constituting the plasma flame-coated layer, i.e., titanium and/or tantalum, for example, an aqueous diluted hydrochloric acid solution of titanium tetrachoride and tantalum pentachloride, is coated on the core material made of a valve metal, burned in air at a temperature of from 450° to 600° C., and the operation is repeated a few times to form an electrically conductive oxide layer.

Then, an oxide layer of titanium and tantalum is formed on the surface of the foregoing core material or on the electrically conductive oxide layer by plasma flame-coating (becoming the plasma flame coated layer). Since the oxides of titanium and tantalum are relatively stable in an aqueous fluoride solution or an aqueous bromide solution and the oxides can be relatively easily obtained, the formation of the oxides is convenient. By adding about 10% by weight tantalum oxide to titanium oxide and sintering the mixture, the oxides (which can be used for plasma flame-coating) can be obtained. In addition, for further improving the electric conductivity of the foregoing titanium oxide and tantalum oxide, metallic titanium can be added thereto. In the plasma flame-coated layer, the rutile-type $(Ti\text{-}Ta)O_{2-x}$ portion has an electric conductivity and remaining tantalum becomes $Ta_2O_5$, which is less in electric conductivity but contributes to the improvement in corrosion resistance.

The content of tantalum in the plasma flame coated layer is preferably from 1 to 50% by weight of titanium, and more preferably about 10%.

The flame-coating powder containing titanium and tantalum can be obtained by mixing a small amount of titanium sponge, rutile type ($TiO_2$), and tantalite (tantalum ore, tantalum oxide) at a definite ratio and heating the mixture to a temperature of from 1200° to 1500° C. in air or in an argon atmosphere, and the mixture is ground into particle sizes of from 1 to 40 μm whereby the powder can be used for flame coating.

Then, the powder is attached to the surface of the core material or the surface of the electrically conductive oxide layer. The thickness of the plasma flame-coated layer is preferably from about 50 to 200 μm. If the thickness is less than 50 μm, the possibility of forming perforations is high, while if the thickness is greater than 200 μm, the flame-coating time becomes long and the flame-coated layer becomes brittle and is liable to peel-off.

There is no particular restriction on the flame-coating condition but since flame coating is carried out at a very high temperature and the reducing property of the atmosphere is liable to become high, it is desirable that a gas having an oxidative property such as air, etc., is used as the atmospheric gas.

Then, the surface of the plasma flame-coated layer thus formed is coated with a liquid containing titanium, tantalum, and platinum, for example, an aqueous diluted hydrochloric acid solution of titanium tetrachloride, tantalum pentachloride, and chloroplatinic acid followed by burning in air at a temperature of from 450° to 550° C. for from 5 to 20 minutes, and the operation is repeated from 2 to 10 times to form an interlayer containing platinum and the oxides of titanium and tantalum. The interlayer has the function of partially plugging the fine pores of the plasma flame-coated layer and simultaneously improving the electric conductivity.

Then, lead dioxide coatings are formed on the surface of the plasma flame-coated layer. If a β-lead dioxide layer (which is conventionally used) is directly formed on the plasma flame-coated layer, the adhesion and the uniformity of the plead dioxide and the plasma flame-coated layer are inferior and, hence, in the present invention, an α-lead dioxide layer is formed between the plasma flame-coated layer and the β-lead dioxide layer. The α-lead dioxide layer can be formed on the plasma flame-coated layer by dissolving (until saturation is reached) a lead monoxide powder (litharge) in an aqueous solution of about 20% sodium hydroxide (30 to 40 g/liter) and carrying out electrolysis using the solution as an electrolytic bath and the foregoing core material as the anode at a temperature of from 20° to 50° C. and a current density of from 0.1 to 10 A/dm$^2$.

Then, a β-lead dioxide layer is further formed on the surface of the α-lead dioxide layer. There is no particular restricion on the method of forming the β-lead dioxide layer and a conventional method can be used. For example, a β-lead dioxide layer is formed on the foregoing α-lead dioxide layer by carrying out an electrolysis using a lead nitrate bath having a concentration of at least 200 g/liter and using the core material having formed thereon the s-lead dioxide layer at a temperature of from 50° to 70° C. and a current density of from 1 to 10 A/dm$^2$ to provide, thus, a desired electrolytic electrode.

The electrolytic electrode thus produced can be used for electrolysis in not only an ordinary electrolyte but also in a corrosive electrolyte for a long period of time and, also, the electrode produced by the foregoing condition can effectively be used for a long time in a fluorine-containing electrolyte regardless of the concentration and kind of fluoride ion. However, the foregoing condition also greatly increases the electrodeposition strain. Hence, for stabilizing the foregoing β-lead dioxide layer of the electrode, by dispersing a stable powder of ceramics such as tantalum oxide, a fluorine resin, etc., or fibers in the plating bath, the apparent electrodeposition strain is removed, whereby the β-lead dioxide layer is stabilized.

The following examples are intended to illustrate the present invention but not to limit it in any way. Unless otherwise indicated, all parts, percents, ratios and the like are by weight.

EXAMPLE 1

The surface of a core material of expand mesh made of titanium having a thickness of 1.5mm was roughened by blasting with iron grits having the largest particle size of 1.2 mm. After acid pickling the core material in a boiling aqueous solution of 20% hydrochloric acid, an aqueous diluted hydrochloric acid solution of titanium tetrachloride and tantalum pentachloride having a composition of titanium/tantalum=90/10 was coated on the surface of the core material, burned at a temperature of 550° C. for 10 minutes, and the coating and burning steps were repeated 5 times to form an electrically conductive oxide layer on the surface of the core material.

Furthermore, a powder of a sintered mixture of titanium oxide and tantalum oxide at a ratio of titanium/tantalum=80/20 containing a slight amount of metallic titanium was attached onto the surface thereof by plasma flame coating to form a plasma flame-coated layer of about 100 μm in thickness.

The surface of the flame-coated layer was coated with an aqueous hydrochloric acid solution containing titanium tetrachloride, tantalum pentachloride, and chloroplatinic acid at a ratio of titanium/tantalum/platinum=45/5/50, burned in air at 520° C. for 30 minutes, and the coating and burning steps were repeated 4 times to form an interlayer.

The core material having formed thereon the interlayer was electrolyzed in an electrolytic bath of 40° C. formed by saturating an aqueous solution of 25% sodium hydroxide with litharge (PbO) at a current density of 1 A/dm$^2$ for 2 hours to form an α-lead dioxide layer on the surface. Then, electrolysis was carried out using an aqueous lead nitrate solution having a concentration of 800 g/liter and using the core material having formed thereon the α-lead dioxide layer as the anode at a current density of 2 A/dm$^2$ for 8 hours to form a β-lead dioxide laye on the α-lead dioxide layer.

When electrolysis was carried out in an aqueous 15% sulfuric acid solution of 60° C. containing 2% hydrogen fluoride using the electrode thus prepared as the anode and a platinum plate as the cathode at a current density of 100 A/dm$^2$, even after 6,000 hours, the electrolysis could be further continued.

On the other hand, when an electrode was prepared by the same method as above except that the titanium-tantalum electrically conductive oxide layer and the plasma flame-coated layer were not formed on the core material and the electrolysis was carried out using the electrode under the same condition as above, after about 4,000 hours, a part of the core material was dissolved out and electrolysis could not be continued.

EXAMPLE 2

An electrode was prepared in the same manner as in Example 1 except that the electrically conductive oxide layer was not formed on the core material. When the electrolysis was conducted using the electrode thus obtained in the same manner as in Example 1, electrolysis could be continued for about 5,800 hours.

The electrolytic electrode of the present invention is composed of a core material made of a valve metal, a plasma flame-coated layer containing the oxides of titanium and tantalum formed on the surface of the core material, an interlayer containing platinum and the oxides of titanium and tantalum formed on the surface of the plasma flame-coated layer, an α-lead dioxide layer formed on the interlayer, and a β-lead dioxide layer formed on the α-lead dioxide layer.

In the electrolytic electrode having the foregoing construction, even when cracks form in the uppermost β-lead dioxide layer, the permeation of the electrolyte into the core material is prevented by the inside α-lead dioxide layer, the interlayer, and the plasma flame-coated layer, whereby the life of the electrode is beneficially prolonged.

The foregoing plasma flame-coated layer has relatively large voids and, hence, it sometimes occurs that the permeation of an electrolyte cannot sufficiently be prevented by the plasma flame-coated layer alone. Also, the affinity of the plasma flame-coated layer and the core material made of a valve metal is insufficient. For preventing the occurrence of these problems, as the present invention, the interlayer is formed on the outside of the plasma flame-coated layer to plug the voids of the plasma flame-coated layer and further, if necessary, a ground layer containing at least one of the metals constituting the plasma flame-coated layer is formed between the plasma flame-coated layer and the core material to improve the affinity of the core material and the plasma flame-coated layer, whereby peeling off of the plasma flame-coated layer can be restrained.

As described above, the electrolytic electrode of the present invention is particularly useful as an electrode in a fluoride-containing elecrolyte but on the other hand, in the case of using the electrode, an electrodeposition strain is liable to become large. For preventing the occurrence of the trouble, the β-lead dioxide layer may be stabilized by dispersing a ceramic powder and/or a fluorine resin powder in the β-lead dioxide layer.

Also, in the production method of an elecrolytic electrode according to the present invention, an electrolytically conductive oxide layer containing titanium and/or tantalum is formed on the surface of a core material made of a valve metal, a plasma flame-coated layer containing the oxides of titanium and tantalum is formed on the electrically conductive oxide layer by a plasma flame-coating method, an interlayer containing platinum and the oxides of titanium and tantalum is formed on the surface of the plasma flame-coated layer by a thermal decomposition method, an α-lead dioxide layer is formed on the interlayer, and then a β-lead dioxide layer is formed on the α-lead dioxide layer.

In the electrolytic electrode mainly composed of lead dioxides thus produced by the method of the present invention, as the foregoing electrolytic electrode of the present invention, even when cracks form in the uppermost β-lead dioxide layer, the permeation of the electrolyte into the core material is prevented by the s-lead dioxide layer, the interlayer, and the plasma coated layer disposed as inside layers of the β-lead dioxide layer and the life of the electrode is prolonged.

The foregoing electrically conductive oxide layer can be formed by burning the core material itself made of a valve metal in air, etc., or by coating a liquid containing titanium and/or tantalum on the core material made of a valve metal and burning the core material in air, etc. By any method, the core material is strongly bonded to the plasma flame-coated layer by the existence of the electrically conductive layer and the life of the electrode can be prolonged.

While the invention has been described in detail and with reference to specific embodiments thereof, it will be apparent to one skilled in the art that various changes and modifications can be made therein without departing from the spirits and scope thereof.

What is claimed is:

1. A method of producing an electrolytic electrode, which comprises forming a plasma flame-coated layer containing oxides of titanium and tantalum on a surface of a core material made of a valve metal by a plasma flame-coating method, forming an interlayer containing platinum and oxides of titanium and tantalum on the surface of the plasma flame-coated layer by a thermal decomposition method, forming an α-lead dioxide layer on the interlayer, and then forming a β-lead dioxide layer on the α-lead dioxide layer.

2. The method of producing an electrolytic electrode as in claim 1, wherein the method further includes a step of forming an electrically conductive oxide layer containing at least one of titanium and tantalum on the surface of a core material made of a valve metal before forming the plasma flame-coated layer.

3. The method of producing an electrolytic electrode as in claim 2, wherein the electrically conductive layer is formed by a direct oxidation of the core material.

4. The method of producing an electrolytic electrode as in claim 2, wherein the electrically conductive layer is formed by a thermal oxidation method.

5. The method of producing an electrolytic electrode as in claim 2, wherein the plasma flame-coated layer has a thickness of from 50 to 200 μm.

6. The method of producing an electrolytic electrode as in claim 2, wherein the tantalum is present in the plasma flame-coated layer in an amount of from 1 to 50% by weight of titanium.

* * * * *